252-99 AU 115 EX
9/8/87 XR 4,692,275

United States Patent [19]
Secemski et al.

[11] Patent Number: 4,692,275
[45] Date of Patent: Sep. 8, 1987

[54] DETERGENT COMPOSITIONS CONTAINING AN ALKYLBENZENE SULFONATE AND ALCOHOL ETHOXYSULFATE SURFACTANT SYSTEM

[75] Inventors: Isaac I. Secemski, Flushing, N.Y.; Jesse L. Lynn, Jr., Englewood, N.J.

[73] Assignee: Lever Brothers Company, New York, N.Y.

[21] Appl. No.: 856,069

[22] Filed: Apr. 23, 1986

[51] Int. Cl.[4] ..... C11D 1/37; C11D 3/075
[52] U.S. Cl. ..... 252/534; 252/532; 252/539; 252/551; 252/553; 252/558; 252/99; 252/174.12
[58] Field of Search ..... 252/532, 534, 539, 551, 252/553, 558

[56] References Cited

U.S. PATENT DOCUMENTS

| | | | |
|---|---|---|---|
| 3,676,374 | 7/1972 | Zaki et al. | 252/551 |
| 3,758,419 | 9/1973 | Hayden et al. | 252/551 |
| 3,892,680 | 7/1975 | Benjamin et al. | 252/532 |
| 4,049,586 | 9/1977 | Collier | 252/532 |
| 4,052,342 | 10/1977 | Fernley et al. | 252/541 |
| 4,054,541 | 10/1977 | Mausner et al. | 252/532 |
| 4,075,129 | 2/1978 | Murata et al. | 252/547 |
| 4,166,039 | 8/1979 | Wise | 252/110 |
| 4,469,605 | 9/1984 | Ramachandran | 252/8.7 |
| 4,487,710 | 12/1984 | Kaminsky | 252/546 |
| 4,554,098 | 11/1985 | Klisch et al. | 252/547 |
| 4,615,819 | 10/1986 | Leng et al. | 252/110 |

FOREIGN PATENT DOCUMENTS

| | | |
|---|---|---|
| 214861 | 9/1956 | Australia . |
| 8141 | 2/1980 | European Pat. Off. . |
| 1408970 | 10/1975 | United Kingdom . |
| 1408969 | 10/1975 | United Kingdom . |
| 1504843 | 3/1978 | United Kingdom . |

*Primary Examiner*—Prince E. Willis
*Attorney, Agent, or Firm*—Milton L. Honig; James J. Farrell

[57] ABSTRACT

A detergent is disclosed with an improved mixed surfactant system containing a $C_8$–$C_{18}$ alkylbenzene sulfonate and a special $C_{12}$–$C_{18}$ alcohol ethoxysulfate formed with from 6 to 30 units ethylene oxide and having an average weight of 60–80% ethylene oxide by weight based on non-sulfated alcohol ethoxylate. The total amount of aforesaid surfactant ranges from 10 to 20% and the ratio of sulfonate to sulfate is from 3.5:1 to 1.5:1.

12 Claims, No Drawings

DETERGENT COMPOSITIONS CONTAINING AN ALKYLBENZENE SULFONATE AND ALCOHOL ETHOXYSULFATE SURFACTANT SYSTEM

BACKGROUND OF THE INVENTION

1. Field of the Invention

This invention relates to detergent compositions with a selected type of mixed anionic surfactant system.

2. The Prior Art

Linear alkylbenzene sulfonate (LAS) is one of the most widely used surfactants in commerce. It finds special application for light and heavy duty liquid and powder detergents. A disadvantage of LAS is that this anionic material can interact with cationic water hardness ions, such as calcium, thereby becoming inactivated through precipitation. While this is a problem common to anionic surfactants, LAS is especially sensitive to water hardness ions.

Although not wishing to be bound by any theory, the literature indicates that the aforementioned interaction can best be understood by considering the micellar structure of LAS. Repulsive forces between negative charges on the sulfonate group lead to a higher critical micelle concentration (CMC) than, for instance, with a nonionic surfactant. CMC is the surfactant concentration at which micellar formation begins. Stated otherwise, the negative charge of LAS inhibits micellar formation and shifts the equilibrium towards the monomer. A relatively high monomer concentration in solution results thereby; this is significant because precipitation between calcium ion and LAS occurs only with the monomer.

Reduction of free LAS concentration (and thereby diminishing LAS sensitivity to calcium) may be accomplished by adding a co-active. A mixed micelle forms between the LAS and co-active at a lower CMC. The co-active helps shield negative charges of LAS from each other in the micelle. Micellar formation is, accordingly, more energetically favorable and lowers free monomer concentration.

Mixed micelle formation may help prevent LAS precipitation in another way. Anionic micelles can complex ions by counterion interaction. An increase in micellar concentration leads to a reduction in free calcium ions with a concomitant decrease in LAS precipitation.

Certain ethoxylated fatty alcohols have been found to be useful co-actives for protecting LAS against precipitation. It is believed that the ethylene oxide chain helps dissipate repulsive forces between negatively charged sulfonate groups of LAS. Powders with the optimum nonionic co-active are, however, generally difficult to process and have poor physical properties.

Alcohol ethoxysulfates have been suggested as co-actives in combination with LAS. Illustrative of such disclosures are U.S. Pat. No. 3,758,419, U.S. Pat. No. 3,892,680, U.S. Pat. No. 4,049,586 and U.S. Pat. No. 4,487,710. These patents do not, however, provide instruction as to the optimum alcohol ethoxysulfate relative to an LAS surfactant system.

Accordingly, it is an object of the present invention to provide a detergent composition capable of optimized cleaning and readily processible.

It is a further object of this invention to provide a co-active which will enhance the effectiveness of LAS.

SUMMARY OF THE INVENTION

A detergent composition is herewith provided consisting essentially of:

(i) a $C_8$–$C_{18}$ alkylbenzene sulfonate;

(ii) a $C_{12}$–$C_{18}$ alcohol ethoxysulfate formed with from 6 to 30 units ethylene oxide, and where the average weight of ethylene oxide is from 60 to 80% by weight based on non-sulfated ethoxylated alcohol; and (iii) from 1 to 90% by weight of a builder salt;

wherein the amount of (i) and (ii) ranges from 10 to 20% and the ratio of said sulfonate to said sulfate is from 3.5:1 to 1.5:1.

DETAILED DESCRIPTION OF THE INVENTION

There have now been identified certain fatty alcohol ethoxysulfates (AES) that are unusually effective as co-actives for LAS. These mixed active systems deliver cleaning improvements similar to those obtained with the best LAS/nonionic systems but without the processibility and powder property negatives associated with these formulations. Optimum carbon chain length and ethylene oxide content have been identified for the alcohol ethoxysulfates. Additionally, there has been identified particular ratios of LAS:AES that critically provide special performance benefits.

It has been found that alcohol ethoxysulfates are unusually effective if chosen from alcohols containing between 12 and 18 carbon atoms ethoxylated to achieve 60–80% by weight ethylene oxide content calculated as non-sulfated ethoxylated alcohol. When LAS is combined with the aforementioned AES, superior performance is achieved when the ratio of surfactants is 3.5:1 to 1.5:1, respectively. Preferably, the ratio of LAS to AES is from 3.0:1 to 1.8:1, most preferably 2.5:1 to 1.8:1.

Particularly preferred AES surfactants are the $C_{12}$–$C_{15}$ alcohol ethoxysulfates with an average of 6–20 moles ethylene oxide and the $C_{16}$–$C_{18}$ alcohol ethoxysulfates with an average of 20–25 moles of ethylene oxide. Most preferred are the $C_{12}$–$C_{15}$ alcohol ethoxysulfates with an average of 6–9 moles ethylene oxide. Specific alcohol ethoxysulfates will be defined in subsequent discussion either by their hydrophobe chain length with percent ethylene oxide in the ethoxylate prior to sulfation or by their hydrophobe chain length with moles of ethylene oxide. For instance in commerce, the Vista Chemical Company uses the first notation for their Alfonic line while the Shell Chemical Company uses the latter notation for their Neodol line of ethoxysulfates. Thus, Alfonic 1214-60OES denotes an alcohol ethoxysulfate prepared by ethoxylation of a $C_{12}$–$C_{14}$ alcohol with 60% by weight ethylene oxide. Neodol 45-7S represents an alcohol ethoxysulfate prepared from a $C_{14}$–$C_{15}$ alcohol hydrophobe and 7 moles of ethylene oxide. Table I provides chemical structures for the various sulfates and correlates this to the Vista and Shell product terminology.

Total surfactant levels, i.e. the combination of LAS and AES, will range from about 10 to 20%. Preferably, the range will be from 12 to 18%. Most preferable will be a range of 14–16% for phosphate built detergent compositions and 16–18% for non-phosphate built detergent compositions.

The detergent compositions of this invention can contain all manner of detergent builders commonly taught for use in detergent compositions. These can include any of the conventional inorganic and organic builders.

Typical of the well known inorganic builders are the sodium and potassium salts of the following: pyrophosphate, tripolyphosphate, orthophosphate, carbonate, bicarbonate, silicate, sesquicarbonate, borate and aluminosilicate. Builder will generally be present from about 10% to about 80% by weight of the composition. Preferably, they will range from about 20% to about 50%, most preferably from about 25% to about 35%.

An especially preferred builder is sodium silicate having a $Na_2O:SiO_2$ ratio of about 1:2.4, although the range of 1:2 to 1:3 is normally useful and often ratios as low as 1:3.2 are acceptable. Concentrations of sodium silicate may range from about 2 to about 35% by weight of the total detergent composition. Preferably, concentrations of about 4 to about 20% are employed in the compositions.

Among the organic detergent builders that can be used in the present invention are the sodium and potassium salts of the following: citrate, amino polycarboxylate, nitrilotriacetates, polyacetal carboxylates, N-(2-hydroxyethyl)-nitrilodiacetates, ethylene diamine tetraacetates, hydroxyethylenediamine tetraacetates, diethylenetriamino pentaacetates, dihydroxyethyl glycine, phytates, polyphosphonates, oxydisuccinates, oxydiacetates, carboxymethyloxysuccinates, polyacrylates, acrylic/maleic acid copolymers, hydrofuran tetracarboxylates, ester linked carboxylate derivatives of polysaccharides such as the sodium and potassium starch maleates, cellulose phthalates, glycogen succinates, semi-cellulose diglycolates, starch and oxidized heteropolymeric polysaccharides. Particularly preferred is sodium polyacrylate of molecular weight 4,500–100,000 sold as Acrysol ® by Rohm & Haas, and acrylic/maleic acid copolymer of molecular weight 50,000–150,000 sold under the mark Sokalan CP ® by BASF Corporation. These preferred builders may be incorporated at a concentration from about 0.1 to 6%, preferably from 1.0 to 5.0%. The foregoing is meant to illustrate but not limit the types of builders that can be employed in the present invention.

Soaps may also be employed as organic detergent builders for compositions of the present invention. They are particularly useful at low levels of about 0.5 to 10%. The soaps which are used are preferably the sodium, or less desirably potassium, salts of saturated or unsaturated $C_{10}$–$C_{24}$ fatty acids or mixtures thereof. Soaps are particularly valuable when the present compositions are used in hard water, wherein the soap acts as a supplementary builder. In addition, soap may also help to decrease the tendency of compositions to form inorganic deposits in the wash, particularly where the composition contains a calcium ion precipitant material such as sodium carbonate or sodium orthophosphate.

Apart from detergent active compounds and builders, compositions of the present invention can contain all manner of minor additives commonly found in laundering or cleaning compositions in amounts in which such additives are normally employed. Examples of these additives include: lather boosters, such as alkanolamides, particularly the monoethanolamides derived from palm kernel fatty acids and coconut fatty acids; foam suppressants, such as fatty acids and their alkali metal salts (soaps), alkyl phosphates, waxes and silicones; particulate soil detergency enhancers such as polyethylene glycols; oxygen-releasing bleaching agents, such as sodium perborate and sodium percarbonate; per-acid bleach precursors; chlorine-releasing bleaching agents, such as trichloroisocyanuric acid and alkali metal salts of dichloroisocyanuric acid; fabric softening agents; inorganic salts, such as sodium sulphate and magnesium silicate; and usually present in very minor amounts, fluorescent whitening agents, perfumes, enzymes, germicides and colorants.

When formulating powder detergents, fillers will normally be incorporated. Among the fillers, sodium sulfate has been found to be a preferable material. Concentrations of about 20% to about 60% by weight of the detergent composition can be usefully employed. Sodium sulfate concentrations of about 35 to about 45% have been found especially preferable in the present invention.

Antiredeposition agents or soil release agents are frequently formulated with detergent compositions. Soil release agents effectively and efficiently deposit from the wash solution onto fabrics. When the fabrics are subsequently soiled, the presence of the soil release agent on the fabrics allows the soil to be more easily removed. Illustrative of the soil release agents are the cellulose ethers and particularly, sodium carboxymethylcellulose, methylcellulose, hydroxyethyl methylcellulose and hydroxypropyl methylcellulose. They may be present from about 0.01% to about 1.0%; preferably, they are present from about 0.05% to about 0.5%.

Small amounts of fluorescent whitening agents generally ranging from about 0.01 to about 0.50% by weight may be incorporated into the detergent compositions. Examples of fluorescent whitening agents include derivatives of diaminostilbene disulfonate-cyanuric chloride, naphthotriazolylstilbene, diphenyltriazolylstilbene and distyrylbiphenyl.

Certain clays may also be present as emulsification and processing aids. Among the preferred clays are diatomaceous earth and dicalite (natural alumino silicate-perlite). These clays can be present in an amount from about 0% to about 2.5%.

The following examples will more fully illustrate the embodiments of this invention. All parts, percentages and proportions referred to herein and in the appended claims are by weight unless otherwise indicated.

EXAMPLE 1

In this and most subsequent Examples, the alcohol ethoxysulfates will be referred to by the short-hand notation shown in the middle column of Table I. The left column lists the surfactant supplier's identification code. Chemical structure is set forth in the right column and includes alkyl carbon chain length and average number of ethylene oxide units per molecule of AES. Thus, for example the first entry, identifies in the left column the supplier's code Alfonic 810-20ES, and in the middle column cites its short-hand notation 810-20ES. The "810" refers to the alkyl group and "20ES" indicates 20% by weight is ethylene oxide based on AES prior to sulfation. The right hand column indicates that this AES is formed from a $C_8$–$C_{10}$ alcohol ethoxylated with an average of 0.9 moles ethylene oxide. It is emphasized that the surfactants listed below are idealized alcohol ether sulfates. In actuality, nominally identical samples of alcohol ether sulfates have carbon chain length and E.O. chain distributions that vary around a norm.

TABLE I

| Trademark Identification | AES Correlation List: Short-Hand Notation (Percent E.O. by Weight) | Structure (Number of E.O. Units per Molecule Sulfate) |
|---|---|---|
| Alfonic 810-20ES | 810-20ES | $C_8$–$C_{10}$ - 0.9EO |
| Alfonic 810-40ES | 810-40ES | $C_8$–$C_{10}$ - 2.3EO |
| Alfonic 810-60ES | 810-60ES | $C_8$–$C_{10}$ - 5.0EO |
| Alfonic 1214-20ES | 1214-20ES | $C_{12}$–$C_{14}$ - 1.2EO |
| Alfonic 1214-40ES | 1214-40ES | $C_{12}$–$C_{14}$ - 3.0EO |
| Alfonic 1214-52ES | 1214-52ES | $C_{12}$–$C_{14}$ - 5.0EO |
| Alfonic 1214-60ES | 1214-60ES | $C_{12}$–$C_{14}$ - 6.0EO |
| Alfonic 1214-65ES | 1214-65ES | $C_{12}$–$C_{14}$ - 8.0EO |
| Alfonic 1214-80ES | 1214-80ES | $C_{12}$–$C_{14}$ - 17.0EO |
| Alfonic 1618-20ES | 1618-20ES | $C_{16}$–$C_{18}$ - 1.5EO |
| Alfonic 1618-40ES | 1618-40ES | $C_{16}$–$C_{18}$ - 4.0EO |
| Alfonic 1618-60ES | 1618-60ES | $C_{16}$–$C_{18}$ - 9.0EO |
| Alfonic 1618-80ES | 1618-80ES | $C_{16}$–$C_{18}$ - 23.0EO |
| Neodol 23-6.5S | 1213-60ES | $C_{12}$–$C_{13}$ - 6.5EO |
| Neodol 23-6.5TS | 1213-63ES | $C_{12}$–$C_{13}$ - 7.5EO |
| Neodol 25-3S | 1215-40ES | $C_{12}$–$C_{15}$ - 3.0EO |
| Neodol 25-9S | 1215-66ES | $C_{12}$–$C_{15}$ - 9.0EO |
| Neodol 45-7S | 1415-60ES | $C_{14}$–$C_{15}$ - 7.0EO |
| Neodol 45-7TS | 1415-62ES | $C_{14}$–$C_{15}$ - 8.0EO |

All of the Examples to follow were done with two standard base formulations, one phosphate and the other non-phosphate. These formulations are outlined below:

| Ingredient | Percent by Weight P* | Percent by Weight NP** |
|---|---|---|
| LAS | 9–16 | 9–18 |
| AES | 0–6 | 0–6 |
| Sodium tripolyphosphate | 25 | — |
| Sodium carbonate | — | 35 |
| Sodium silicate | 8 | 20 |
| Sodium carboxymethyl cellulose | 0.3 | 0.3 |
| Sodium sulfate, water | to 100% | to 100% |

*Total Active 14–16%
**Total Active 16–18%

Soil detergency evaluations were done in accordance with the conditions of temperature and water hardness recommended by ASTM-D12 Committee on Consumer Standards for Laundry Products. The wash loads employed Lever Clay test cloths. Wash temperature was held at 100° F. with a 10-minute wash followed by a 1-minute rinse. Performance evaluations were done both for a composite mixture of ingredients added over-the-side and for fully formulated detergent powders. Values entered in the Tables refer to the change in reflectance of a cloth washed in the sample formulation versus a cloth washed with the control formulation. With regard to phosphate systems, the control formulation contained 16% LAS; non-phosphate system control formulations contained 18% LAS.

The present Example reports the results of a screening to identify the best alcohol ether sulfate for use with LAS. A range of alcohol ether sulfates were tested including $C_8$–$C_{10}$, $C_{12}$–$C_{14}$, and $C_{16}$–$C_{18}$ alkyl hydrophobes, each with 20%, 40% and 60% by weight ethylene oxide. These were evaluated in the phosphate formula with 12% LAS and 4% AES. Clay cloth detergency data are shown in Table II. All detergency values were taken relative to a control containing only LAS at 16%. Error limits are denoted as Least Significant Difference (LSD) at the foot of each column. Where there was no significant difference, the term (nsd) was entered.

TABLE II

Detergency Results - 12% LAS/4% AES in a Phosphate Base

| AES | Values as ΔRd Hardness (ppm): 30 | 60 | 90 | 120 | 150 | 180 |
|---|---|---|---|---|---|---|
| 810-20ES | −0.1 | 0.2 | 0.1 | −0.5 | −0.8 | −0.4 |
| 810-40ES | 0.3 | −0.1 | −0.3 | −0.9 | −0.1 | 0.2 |
| 810-60ES | 0.1 | 0.1 | 0.6 | −0.1 | 0.3 | −0.1 |
| 1214-20ES | −0.1 | 0.8 | 1.0 | 1.3 | 0.7 | 0.8 |
| 1214-40ES | 0.2 | 0.4 | 0.8 | 1.2 | 2.0 | 1.7 |
| 1214-60ES | 0.2 | 0.4 | 1.0 | 3.8 | 5.9 | 6.0 |
| 1618-20ES | −0.1 | 0.3 | 0.7 | 0.2 | −0.4 | −0.3 |
| 1618-40ES | 0.5 | 1.8 | 0.7 | 1.1 | 2.2 | 1.5 |
| 1618-60ES | −0.1 | 1.8 | 1.0 | 1.7 | 2.7 | 3.4 |
| (LSD) | (nsd) | (0.7) | (0.5) | (0.8) | (0.9) | (0.7) |

The ΔRd data show that 1214-60ES and, to a lesser extent, 1618-60ES minimize inactivation of LAS. They partially prevent the decline in cleaning performance associated with high water hardness.

To better define the optimum carbon and EO chain lengths for co-active effectiveness, the degree of ethoxylation of $C_{12}$–$C_{14}$ and $C_{16}$–$C_{18}$ hydrophobes were further varied. These data are presented in Tables III and IV.

TABLE III

Detergency Results - 12% LAS/4% AES ($C_{12}$–$C_{14}$) in a Phosphate Base

| AES | Values as ΔRd Hardness (ppm): 30 | 60 | 90 | 120 | 150 | 180 |
|---|---|---|---|---|---|---|
| 1214-40 | 1.3 | 0.7 | 0.0 | 1.6 | 2.9 | 2.5 |
| 1214-52 | 0.8 | 0.3 | −0.5 | 1.7 | 3.6 | 2.3 |
| 1214-65 | 0.8 | 0.7 | 0.5 | 2.6 | 4.9 | 4.7 |
| 1214-80 | 1.5 | −0.3 | −0.4 | 2.0 | 5.1 | 5.6 |
| (LSD) | (0.5) | (0.3) | (0.5) | (0.6) | (0.7) | (0.9) |

TABLE IV

Detergency Results - 12% LAS/4% AES ($C_{16}$–$C_{18}$) in a Phosphate Base

| AES | Values as ΔRd Hardness (ppm): 60 | 120 | 180 |
|---|---|---|---|
| 1618-60 | 0.2 | 2.5 | 2.3 |
| 1618-80 | −0.4 | 3.1 | 2.3 |
| (LSD) | (nsd) | (0.7) | (0.8) |

All the mixed active systems in Tables III and IV show improvements over LAS alone in underbuilt conditions (>100 ppm). In particular, performance of $C_{12}$–$C_{14}$ alcohol ethoxysulfates sharply increases at around 60% by weight ethylene oxide content. It stays roughly constant up to 80% of ethylene oxide. A small increase in performance is noted with $C_{16}$–$C_{18}$ when going from 60% to 80% by weight ethylene oxide. The improvements delivered by the optimum $C_{12}$–$C_{14}$ co-actives are, however, larger than those of the optimum $C_{16}$–$C_{18}$ co-actives.

EXAMPLE 2

The present Example demonstrates performance effects upon varying the LAS/AES ratio. Example 1 was limited to a constant LAS/AES evaluation. Herein, there is shown the detergency effect for the optimum performing alcohol ethoxysulfates, 1214-60ES, 1214-80ES and 1618-80ES.

A control with 16% LAS was compared to formulations with LAS/AES ratios of 11/3, 10/4 and 9/5. Total active level was reduced to 14% in this experiment because of the high activity with the particular mixed actives chosen. Another reason for selecting 14% was because mixed active formulations are more difficult to process than those of LAS alone. These difficulties can be minimized by reducing the total active level. A 12% LAS/4% AES formulation is included for continuity with results of Example 1.

TABLE V

Detergency Results - Effect of LAS/1214-60ES Ratio in a Phosphate Base

| Total Active (%) | LAS/1214-60ES | Values as ΔRd Hardness (ppm) 60 | 90 | 120 | 150 | 180 | 210 |
|---|---|---|---|---|---|---|---|
| 16 | 12/4 | 0.7 | 0.5 | 3.9 | 3.9 | 3.3 | 3.3 |
| 14 | 11/3 | 0.4 | 0.3 | 2.8 | 3.0 | 2.7 | 1.5 |
| 14 | 10/4 | 0.6 | 0.7 | 4.0 | 4.3 | 4.5 | 2.1 |
| 14 | 9/5 | 1.1 | 0.8 | 4.2 | 4.4 | 4.7 | 2.8 |
| — | (LSD) | (nsd) | (nsd) | (0.7) | (0.6) | (0.7) | (0.6) |

TABLE VI

Detergency Results - Effect of LAS/1214-80ES Ratio in a Phosphate Base

| Total Active (%) | LAS/1214-80ES | Values as ΔRd Hardness (ppm) 60 | 90 | 120 | 150 | 180 | 210 |
|---|---|---|---|---|---|---|---|
| 16 | 12/4 | 0.8 | 1.3 | 2.1 | 7.2 | 7.1 | 4.7 |
| 14 | 11/3 | 0.7 | 1.4 | 2.3 | 5.6 | 6.2 | 4.2 |
| 14 | 10/4 | 0.4 | 1.6 | 2.7 | 7.2 | 8.2 | 6.6 |
| 14 | 9/5 | 0.8 | 1.9 | 3.9 | 7.8 | 10.0 | 7.6 |
| — | (LSD) | (0.4) | (0.6) | (0.8) | (1.4) | (1.0) | (1.0) |

TABLE VII

Detergency Results - Effect of LAS/1618-80ES Ratio in a Phosphate Base

| Total Active (%) | LAS/1618-80ES | Values as ΔRd Hardness (ppm) 60 | 120 | 180 |
|---|---|---|---|---|
| 16 | 12/4 | 0.1 | 0.7 | 3.8 |
| 14 | 11/3 | 0.2 | 1.6 | 3.0 |
| 14 | 10/4 | −0.2 | 0.9 | 4.2 |
| 14 | 9/5 | −0.1 | 2.3 | 4.9 |
| — | (LSD) | (nsd) | (1.0) | (0.9) |

Tables V–VII confirm the good performance of mixed active systems containing $C_{12}$–$C_{14}$ alcohol ethoxysulfates over the $C_{16}$–$C_{18}$ surfactants. There is also a consistent trend toward improved performance at an LAS/AES ratio at ratios lower than 3.7:1 (i.e. 11/3). Ratios lower than 1.5:1 are more difficult to process.

EXAMPLE 3

The present Example is intended to show the effect of alcohol ethoxysulfate types and LAS/AES ratio using complete processed powders, i.e. detergent powders that have been processed through a spray tower. In Example 2, identical formulations had been evaluated where the ingredients were added "over-the-side" to the Terg-o-tometer wash beaker as separate ingredients. Powders with LAS and 1214-40ES, 1214-60ES, 1214-80ES, 1618-60ES and 1618-80ES at ratios of 11/3, 10/4 and 9/5 were compared to a powder control with 16% LAS. Data corresponding to these experiments are listed in Tables VIII–XII. The detergency of the tower processed control powder drops off at 150 ppm whereas the mixture of components added over-the-side drops off at 120 ppm. This is consistent with partial breakdown of sodium tripolyphosphate to sodium pyrophosphate and orthophosphate during powder manufacture which gives a building system superior to that of sodium tripolyphosphate alone. Nevertheless, the results for the mixed active systems prepared through tower spraying and those obtained for over-the-side addition of ingredients are consistent with one another. Thus, the benefits of the mixed active system are seen in underbuilt conditions (>120 ppm). The most effective alcohol ethoxysulfates are 1214-60ES and 1214-80ES followed by 1618-80ES, with lower E.O. material being significantly poorer performing. An LAS/AES ratio of 2.5:1 or less is particularly effective.

TABLE VIII

Detergency Results - Effect of LAS/1214-80ES Ratio in a Phosphate Base

| Total Active (%) | LAS/1214-80ES | Values as ΔRd Hardness (ppm) 60 | 90 | 120 | 150 | 180 |
|---|---|---|---|---|---|---|
| 14 | 11/3 | 0.3 | 1.8 | 0.5 | 1.6 | 2.7 |
| 14 | 10/4 | 0.2 | 1.1 | 0.4 | 3.7 | 7.9 |
| 14 | 9/5 | 0.1 | 1.4 | 0.0 | 3.4 | 7.8 |
| — | (LSD) | (nsd) | (0.4) | (nsd) | (0.9) | (0.9) |

TABLE IX

Detergency Results - Effect of LAS/1214-60ES Ratio in a Phosphate Base

| Total Active (%) | LAS/1214-60ES | Values as ΔRd Hardness (ppm) 60 | 90 | 120 | 150 | 180 | 210 |
|---|---|---|---|---|---|---|---|
| 14 | 11/3 | −0.1 | 0.4 | 0.1 | 2.3 | 2.4 | 1.7 |
| 14 | 10/4 | −0.2 | 1.0 | 0.4 | 4.4 | 4.9 | 3.4 |
| 14 | 9/5 | 0.1 | 0.4 | 1.4 | 4.9 | 5.6 | 4.9 |
| — | (LSD) | (nsd) | (0.7) | (0.7) | (0.6) | (0.9) | (0.8) |

TABLE X

Detergency Results - Effect of LAS/1214-40ES Ratio in a Phosphate Base

| Total Active (%) | LAS/1214-40ES | Values as ΔRd Hardness (ppm) 60 | 90 | 120 | 150 | 180 | 210 |
|---|---|---|---|---|---|---|---|
| 14 | 11/3 | 0.3 | 0.0 | −0.1 | −0.1 | 1.7 | 1.7 |
| 14 | 10/4 | 1.2 | 0.2 | −0.2 | 0.5 | 2.0 | 3.2 |
| 14 | 9/5 | 0.2 | 0.0 | 0.3 | 2.1 | 3.6 | 3.8 |
| — | (LSD) | (0.6) | (nsd) | (nsd) | (0.6) | (0.9) | (0.9) |

TABLE XI

Detergency Results - Effect of LAS/1618-80ES Ratio in a Phosphate Base

| Total Active (%) | LAS/1618-80ES* | Values as ΔRd Hardness (ppm) 60 | 90 | 120 | 150 | 180 | 210 |
|---|---|---|---|---|---|---|---|
| 14 | 11/3 | 0.1 | 0.8 | 2.0 | 2.4 | 3.2 | 3.2 |
| 14 | 10/4 | −0.2 | 0.7 | 2.0 | 2.7 | 4.5 | 4.3 |
| — | (LSD) | (nsd) | (nsd) | (0.4) | (nsd) | (nsd) | (2.2) |

*Powder with LAS/AES ratio 9/5 was unavailable for evaluation.

TABLE XII

Detergency Results - Effect of LAS/1618-60ES Ratio in a Phosphate Base

| Total Active (%) | LAS/1618-60ES | Values as ΔRd Hardness (ppm) 60 | 90 | 120 | 150 | 180 | 210 |
|---|---|---|---|---|---|---|---|
| 14 | 11/3 | −0.8 | 0.8 | 1.1 | 2.9 | 2.2 | 1.8 |
| 14 | 10/4 | 0.0 | 0.0 | 0.1 | 3.0 | 2.5 | 1.5 |
| 14 | 9/5 | 0.3 | −0.9 | 0.5 | 2.7 | 2.2 | 2.5 |

TABLE XII-continued

| Detergency Results - Effect of LAS/1618-60ES Ratio in a Phosphate Base | | | | | | | |
|---|---|---|---|---|---|---|---|
| Total Active (%) | LAS/1618-60ES | Values as ΔRd Hardness (ppm) 60 | 90 | 120 | 150 | 180 | 210 |
| — | (LSD) | (0.6) | (nsd) | (0.7) | (0.6) | (0.5) | (0.8) |

EXAMPLE 4

This Example illustrates the effects of alcohol ethoxysulfate type and LAS/AES ratio in a non-phosphate system. All ingredients were added "over-the-side". The control contained 18% LAS while the mixed active ratios of LAS/AES were 15/3, 14/4 and 12/6 (18% total actives), and 12/4 and 11/5 (16% total actives). Most of the testing was done with Alfonic 1214-80ES, 1214-60ES, 1618-80ES and 1618-60ES. Data for detergency of the foregoing combinations may be found in Tables XII to XVI. A review of the Tables indicates that the benefits of the mixed active systems are larger in the carbonate base than in the phosphate base. This is consistent with the poor building of the carbonate base. Benefits of a hardness-insensitive active system thus become more important with carbonate. The trend seen in the phosphate base are also evident here. Thus, 1214-60ES and 1214-80ES were the best co-actives with 1618-80ES somewhat poorer and 1618-60ES less effective still. Stated otherwise, the $C_{12}$–$C_{14}$ alcohol ether sulfates were preferred over those of $C_{16}$–$C_{18}$. There was also an improvement in performance in going from 60% to 80% by weight ethylene oxide at fixed hydrophobe, particularly for the $C_{16}$–$C_{18}$ products. An LAS/AES ratio of around 2:1 is seen to be particularly preferred. For the most effective systems, 1214-60ES and 1214–80ES, the 11/5 mixture performs as well as the 12/6 mixture despite a reduction in total actives level. The 5:1 ratio (15/3) performs poorest with a ratio of about 3:1 (14:4 and 12:4) giving intermediate performance.

TABLE XIII

| Detergency Results - Effect of LAS/1214-80ES Ratio in a Carbonate Base | | | | | | | |
|---|---|---|---|---|---|---|---|
| Total Active (%) | LAS/1214-80ES | Values as ΔRd Hardness (ppm) 30 | 60 | 90 | 120 | 150 | 180 |
| 18 | 15/3 | 1.4 | 2.3 | 3.8 | 3.9 | 4.5 | 2.6 |
| 18 | 14/4 | 1.2 | 3.1 | 4.9 | 7.4 | 6.0 | 4.9 |
| 16 | 12/4 | 1.0 | 4.2 | 6.0 | 5.2 | 6.5 | 5.0 |
| 18 | 12/6 | 1.4 | 4.7 | 7.0 | 10.0 | 9.5 | 7.9 |
| 16 | 11/5 | 1.2 | 4.1 | 6.8 | 8.9 | 9.5 | 6.8 |
| — | (LSD) | (nsd) | (1.4) | (1.8) | (3.0) | (1.2) | (2.1) |

TABLE XIV

| Detergency Results - Effect of LAS/1214-60ES Ratio in a Carbonate Base | | | | | | | |
|---|---|---|---|---|---|---|---|
| Total Active (%) | LAS/1214-60ES | Values as ΔRd Hardness (ppm) 30 | 60 | 90 | 120 | 150 | 180 |
| 18 | 15/3 | 0.5 | 2.4 | 3.0 | 3.7 | 4.9 | 2.1 |
| 18 | 14/4 | 0.5 | 2.9 | 4.6 | 3.6 | 5.1 | 3.2 |
| 16 | 12/4 | 0.1 | 3.0 | 4.6 | 5.4 | 4.6 | 4.0 |
| 18 | 12/6 | 0.2 | 3.6 | 6.1 | 6.5 | 8.1 | 5.9 |
| 16 | 11/5 | 0.7 | 2.9 | 6.5 | 7.1 | 8.1 | 6.1 |
| — | (LSD) | (nsd) | (0.5) | (1.6) | (0.9) | (2.4) | (2.5) |

TABLE XV

| Detergency Results - Effect of LAS/1618-80ES Ratio in a Carbonate Base | | | | |
|---|---|---|---|---|
| Total Active (%) | LAS/1618-80ES | Values as ΔRd Hardness (ppm) 30 | 90 | 150 |
| 18 | 15/3 | 0.1 | 3.0 | 1.5 |
| 18 | 14/4 | 0.8 | 4.3 | 3.6 |
| 16 | 12/4 | −0.5 | 5.5 | 5.0 |
| 18 | 12/6 | 0.0 | 5.9 | 6.1 |
| 16 | 11/5 | 0.5 | 6.0 | 3.8 |
| — | (LSD) | (nsd) | (0.9) | (1.1) |

TABLE XVI

| Detergency Results - Effect of LAS/1618-60ES Ratio in a Carbonate Base | | | | |
|---|---|---|---|---|
| Total Active (%) | LAS/1618-60ES | Values as ΔRd Hardness (ppm) 30 | 90 | 150 |
| 18 | 15/3 | −1.4 | 2.3 | 4.2 |
| 18 | 14/4 | −0.3 | 3.3 | 2.6 |
| 16 | 12/4 | −1.0 | 2.6 | 1.3 |
| 18 | 12/6 | 0.1 | 4.3 | 4.8 |
| 16 | 11/5 | −0.1 | 3.6 | 4.2 |
| — | (LSD) | (0.7) | (0.9) | (2.6) |

EXAMPLE 5

The following Example is identical with the previous one except that instead of over-the-side separate addition of ingredients, spray tower processed powders with identical ingredients were evaluated. In this study, LAS/AES ratios of 18/0, 14/4, 12/6 and 11/5 were tested. Detergency results are presented in Tables XVII–XXIV.

The results from the fully formulated carbonate powder parallel those seen with the over-the-side addition of ingredients. They also follow the same trends observed in the phosphate system. Thus, 1214-60ES, 1214-80ES and 1618-80ES were the best co-actives. These were substantially superior to 1214-20ES, 1618-20ES and 1618-40ES. Intermediate levels of performance improvement were obtained with 1618-60ES and 1214-40ES.

TABLE XVII

| Detergency Results - Effect of LAS/1214-80ES Ratio in a Carbonate Base | | | | | | |
|---|---|---|---|---|---|---|
| LAS/1214-80ES* | Values as ΔRd Hardness (ppm) 30 | 60 | 90 | 120 | 150 | 180 |
| 14/4 | 0.7 | 4.3 | 8.5 | 4.7 | 4.4 | 2.8 |
| (LSD) | (nsd) | (0.6) | (2.1) | (2.1) | (2.8) | (1.8) |

*Powder with lower LAS/AES ratios were unavailable for evaluation.

TABLE XVIII

| Detergency Results - Effect of LAS/1214-60ES Ratio in a Carbonate Base | | | | | | | |
|---|---|---|---|---|---|---|---|
| Total Active (%) | LAS/1214-60ES | Values as ΔRd Hardness (ppm) 30 | 60 | 90 | 120 | 150 | 180 |
| 18 | 12/6 | — | 4.6 | — | 8.1 | — | 7.7 |
| 16 | 11/5 | −0.6 | 1.5 | 5.1 | 5.2 | 7.0 | 5.2 |
| — | (LSD) | (nsd) | (0.5) | (0.6) | (1.1) | (0.7) | (0.6) |

TABLE XIX

Detergency Results - Effect of LAS/1214-40ES Ratio in a Carbonate Base

| Total Active (%) | LAS/1214-40ES | Values as ΔRd Hardness (ppm) 30 | 60 | 90 | 120 | 150 | 180 |
|---|---|---|---|---|---|---|---|
| 18 | 14/4 | 1.2 | 2.9 | 3.0 | 2.8 | 2.6 | 2.5 |
| 18 | 12/6 | 1.0 | 2.8 | 2.6 | 4.8 | 4.0 | 3.4 |
| 16 | 11/5 | 0.8 | 2.7 | 3.7 | 4.3 | 2.9 | 3.6 |
| — | (LSD) | (nsd) | (0.8) | (2.0) | (0.7) | (0.5) | (0.7) |

TABLE XX

Detergency Results - Effect of LAS/1214-20ES Ratio in a Carbonate Base

| Total Active (%) | LAS/1214-20EC | Values as ΔRd Hardness (ppm) 30 | 60 | 90 | 120 | 150 | 180 |
|---|---|---|---|---|---|---|---|
| 18 | 14/4 | 0.1 | 1.7 | 1.8 | 1.7 | 0.6 | 0.2 |
| 18 | 12/6 | 0.8 | 2.0 | 2.2 | 3.2 | 2.2 | 2.1 |
| 16 | 11/5 | 0.0 | 1.8 | 1.5 | 1.4 | 1.3 | 0.5 |
| — | (LSD) | (nsd) | (nsd) | (nsd) | (0.7) | (nsd | (1.0) |

TABLE XXI

Detergency Results - Effect of LAS/1618-80ES Ratio in a Carbonate Base

| Total Active (%) | LAS/1618-80ES | Values as ΔRd Hardness (ppm) 30 | 60 | 90 | 120 | 150 | 180 |
|---|---|---|---|---|---|---|---|
| 18 | 14/4 | 0.2 | 2.5 | 7.0 | 4.9 | 6.3 | 3.5 |
| 18 | 12/6 | 1.0 | 3.4 | 9.3 | 8.0 | 6.9 | 5.6 |
| 16 | 11/5 | 1.7 | 4.2 | 7.8 | 7.0 | 7.8 | 6.6 |
| — | (LSD) | (nsd) | (0.6) | (2.1) | (2.1) | (2.8) | (1.8) |

TABLE XXII

Detergency Results - Effect of LAS/1618-60ES Ratio in a Carbonate Base

| Total Active (%) | LAS/1618-60ES | Values as ΔRd Hardness (ppm) 30 | 60 | 90 | 120 | 150 | 180 |
|---|---|---|---|---|---|---|---|
| 18 | 14/4 | −0.5 | 1.6 | 4.8 | 4.3 | 4.7 | 4.2 |
| 18 | 12/6 | −0.4 | 1.9 | 4.4 | 5.5 | 5.9 | 5.9 |
| 16 | 11/5 | −0.8 | 1.4 | 4.5 | 3.9 | 4.9 | 5.1 |
| — | (LSD) | (nsd) | (1.1) | (0.6) | (0.5) | (0.9) | (3.4) |

TABLE XXIII

Detergency Results - Effect of LAS/1618-40ES Ratio in a Carbonate Base

| Total Active (%) | LAS/1618-40ES | Values as ΔRd Hardness (ppm) 30 | 60 | 90 | 120 | 150 | 180 |
|---|---|---|---|---|---|---|---|
| 18 | 14/4 | −0.2 | 1.8 | 2.2 | 2.5 | 1.6 | 0.9 |
| 18 | 12/6 | 0.3 | 0.7 | 2.7 | 1.5 | 1.9 | 0.7 |
| 16 | 11/5 | 0.8 | 1.5 | 2.4 | 1.7 | 0.2 | −0.6 |
| — | (LSD) | (0.4) | (0.5) | (nsd) | (nsd) | (0.8) | (nsd) |

TABLE XXIV

Detergency Results - Effect of LAS/1618-20ES Ratio in a Carbonate Base

| Total Active (%) | LAS/1618-20ES | Values as ΔRd Hardness (ppm) 30 | 60 | 90 | 120 | 150 | 180 |
|---|---|---|---|---|---|---|---|
| 18 | 14/4 | 0.6 | −0.8 | 1.2 | 0.6 | 0.1 | 0.7 |
| 18 | 12/6 | −0.4 | 1.2 | 1.6 | 0.3 | −1.3 | −0.6 |
| 16 | 11/5 | −0.1 | 0.6 | 1.2 | 0.3 | −1.1 | 0.6 |
| — | (LSD) | (0.5) | (nsd) | (nsd) | (nsd) | (nsd) | (1.0) |

EXAMPLE 6

The present Example illustrates results achieved with Neodol type AES surfactants. These materials are similar to the optimum performing Alfonic type and were tested to confirm the results reported in the foregoing Examples of special benefits obtained by the defined mixed active system. Evaluations of Neodol products were conducted on a modified version of the non-phosphate base powder earlier reported in Example 1. The formulation is listed in Table XXV.

Detergency values are reported in Table XXVI concerning Neodol 23-6.5S, 23-6.5TS, 25-9S, 45-7S and 45-7TS, all of which have the preferred hydrophobic and ethylene oxide content as identified by the work with related Alfonic products. It is seen from the results listed in Table XXVI that the aforementioned Neodol surfactants delivered good detergency in combination with LAS. Neodol 25-3S, an alcohol ethoxysulfate commonly used as a coactive for LAS, is shown in the Table to be significantly inferior in detergency to the Neodol products which define the present invention.

TABLE XXV

Base Detergent Powder for Neodol Evaluations

| Ingredient | % by Weight |
|---|---|
| LAS | 12 |
| AES | 6 |
| Sodium carbonate | 19 |
| Sodium silicate | 20 |
| Sodium carboxymethyl cellulose | 0.35 |
| Sodium sulfate, water | to 100% |

TABLE XXVI

Detergency Results For Optimum Neodol Alcohol Ethoxysulfates 12% LAS/6% AES in a Carbonate Base

| | Values as ΔRd Hardness (ppm) 30 | 60 | 90 | 120 | 150 | 180 |
|---|---|---|---|---|---|---|
| Novel Alfonic 1412-60ES | 7.0 | 7.7 | 6.4 | 5.4 | 5.9 | 5.1 |
| Neodol 25-3S | 1.9 | 1.8 | 3.1 | 2.9 | 2.2 | 1.7 |
| Neodol 23-6.5S | 5.8 | 5.6 | 5.2 | 4.5 | 5.2 | 4.3 |
| Neodol 23-6.5TS | 4.7 | 7.7 | 6.0 | 5.8 | 5.9 | 5.3 |
| Neodol 25-9S | 7.0 | 8.2 | 8.3 | 6.2 | 7.6 | 5.9 |
| Neodol 45-7S | 7.1 | 7.3 | 7.0 | 5.1 | 6.6 | 5.0 |
| Neodol 45-7TS | 7.1 | 9.0 | 8.2 | 7.2 | 7.1 | 7.0 |
| | (0.9) | (0.7) | (0.5) | (0.8) | (1.0) | (0.9) |

The foregoing description and examples illustrate selected embodiments of the present invention and in light thereof variations and modifications will be suggested to one skilled in the art, all of which are in the spirit and purview of this invention.

What is claimed is:

1. A detergent composition consisting essentially of:
(i) a $C_8$–$C_{18}$ alkylbenzene sulfonate;
(ii) a $C_{12}$–$C_{15}$ alcohol ethoxysulfate formed with from 6 to 30 units ethylene oxide, and where the average weight of ethylene oxide is from 60 to 80% by weight based on non-sulfated ethoxylated alcohol; and
(iii) from 20 to 50% by weight of a builder
wherein the amount of (i) to (ii) ranges from 10 to 20% and the ratio of said sulfonate to said sulfate is from 3.5:1 to 1.5:1.

2. A detergent composition according to claim 1 wherein the ratio of alkylbenzene sulfonate to alcohol ethoxysulfate is 2.5:1 to 1.8:1.

3. A detergent composition according to claim 1 wherein the alcohol ethoxysulfate is a $C_{12}$–$C_{15}$ alkyl type ethoxylated with an average of 6–20 moles ethylene oxide.

4. A detergent composition according to claim 1 wherein the alcohol ethoxysulfate is a $C_{12}$–$C_{15}$ alkyl type ethoxylated with an average of 6–9 moles ethylene oxide.

5. A detergent composition according to claim 1 wherein the builder salt is sodium carbonate in an amount from about 15% to about 30%.

6. A detergent composition according to claim 1 wherein the builder salt is sodium tripolyphosphate present in an amount from about 20% to about 40%.

7. A detergent composition according to claim 1 wherein the builder salt is present in an amount of about 0.1 to about 6% and selected from the group consisting of sodium polyacrylate, acrylic/maleic acid copolymer, polyacetal carboxylate and mixtures thereof.

8. A detergent composition according to claim 1 wherein the builder salt is sodium silicate present in an amount from about 2% to about 35%.

9. A detergent composition according to claim 1 further comprising from about 0.01 to about 1.0% of a cellulose ether.

10. A detergent composition according to claim 9 wherein the cellulose ether is sodium carboxymethylcellulose ether.

11. A detergent composition according to claim 1 further comprising from about 20 to about 60% of sodium sulfate.

12. A detergent composition according to claim 1 further comprising in an amount from 0.1 to 80% of detergent adjuncts selected from the group consisting of inorganic fillers, fabric softeners, foam suppressants, lather boosters, perfumes, fabric brighteners, particulate soil detergency enhancers, bleaching agents, bleaching agent catalysts, colorants, antiredeposition agents, enzymes, germicides, and mixtures thereof.

* * * * *